US012104367B2

(12) United States Patent
Jeong et al.

(10) Patent No.: US 12,104,367 B2
(45) Date of Patent: Oct. 1, 2024

(54) UPPER RETRACTABLE CONTROLLER FOR BIDET FILTER

(71) Applicant: Bian Co., Ltd., Sejong-si (KR)

(72) Inventors: Jae Geun Jeong, Sejong-si (KR); Yong Sun Sin, Seoul (KR)

(73) Assignee: BIAN CO., LTD., Sejong-si (KR)

( * ) Notice: Subject to any disclaimer, the term of this patent is extended or adjusted under 35 U.S.C. 154(b) by 0 days.

(21) Appl. No.: 18/470,449

(22) Filed: Sep. 20, 2023

(65) Prior Publication Data

US 2024/0183143 A1 Jun. 6, 2024

(30) Foreign Application Priority Data

Nov. 30, 2022 (KR) ..... 10-2022-0164076

(51) Int. Cl.
*E03D 9/08* (2006.01)

(52) U.S. Cl.
CPC ..... *E03D 9/08* (2013.01)

(58) Field of Classification Search
CPC ..... E03D 9/08
USPC ..... 4/443–448
See application file for complete search history.

(56) References Cited

FOREIGN PATENT DOCUMENTS

| | | | | | |
|---|---|---|---|---|---|
| KR | 20050004542 | A | | 1/2005 | |
| KR | 20100021829 | A | * | 2/2010 | ..... H01H 9/025 |
| KR | 20150145763 | A | | 12/2015 | |
| KR | 20210023714 | A | | 3/2021 | |
| KR | 20210072379 | A | * | 6/2021 | ..... H01H 9/025 |
| KR | 20220078196 | A | * | 6/2022 | ..... H01H 9/025 |
| KR | 20220093892 | A | * | 7/2022 | ..... H01H 9/025 |

* cited by examiner

*Primary Examiner* — Lori L Baker
(74) *Attorney, Agent, or Firm* — CANTOR COLBURN LLP

(57) ABSTRACT

An upper retractable controller for a bidet filter, includes a controller main body from which a capsule type bidet filter is detachable through an upper portion, a water supply part configured inside the controller main body and supplying raw water to the bidet filter, an operation part configured in the controller main body and controlling the water supply part, an opening and closing cover part coupled to the upper portion of the controller main body and sealing the bidet filter, and a filter detachable frame provided in the controller main body and on which the bidet filter is detachably seated to support an inflow of water and a supply of purified cleaning water to a nozzle assembly of a bidet.

8 Claims, 9 Drawing Sheets

UPPER RETRACTABLE CONTROLLER FOR BIDET FILTER

CROSS-REFERENCE TO RELATED APPLICATION

The present application is based upon and claims the benefit of priority to Korean Patent Application No. 10-2022-0164076, filed on Nov. 30, 2022, the disclosure of which is hereby incorporated by reference herein in its entirety.

TECHNICAL FIELD

The present disclosure relates to an upper retractable controller for a bidet filter, and more specifically, to an upper retractable controller for a bidet filter, which allows a capsule type bidet filter that purifies cleaning water to be detachably coupled to an upper portion of a controller that controls the operation of the bidet and also controls whether or not to supply the cleaning water, thereby providing the convenience of replacing the capsule type bidet filter.

BACKGROUND

Generally, a bidet is equipped with a bidet filter for filtering the water supplied to the nozzle, and the bidet filter is made detachable so that it is replaced at regular intervals.

Meanwhile, the bidet filter is generally installed adjacent to the water hydrant near the toilet seat, but the toilet seat does not have a separate structure to install the bidet filter, and in the related art, the bidet filter is generally installed on the pipe connected to the water hydrant to supply the water to the nozzle.

However, when the bidet filter is installed as described above in the related art, there is a problem in that it is visually not appealing. In addition, it is difficult to replace the bidet filter because the bidet filter is installed in a small space, and if the bidet filter is connected to the bidet body, it is also difficult to replace and assemble the bidet filter because the parts of the bidet body should be disassembled for replacing the bidet filter.

It is to be noted that the background or related art described above is only for helping to understand the technical meaning of the present disclosure, and does not mean a technique widely known in the technical field to which the present disclosure pertains before the application of the present disclosure.

SUMMARY

In order to solve one or more problems (e.g., the problems described above and/or other problems not explicitly described herein), an object of the present disclosure to provide an upper retractable controller for a bidet filter, which allows a capsule type bidet filter that purifies cleaning water to be detachably coupled to an upper portion of the controller that controls the operation of the bidet and also controls whether or not to supply the cleaning water, thereby providing the convenience of replacing the capsule type bidet filter.

It should be understood, however, that the scope of the present disclosure is not limited to the above and that the objects and effects which can be understood from the solution means and the embodiments of the present disclosure are also included therein even if not explicitly mentioned.

According to an embodiment of the present disclosure for achieving the above object, the disclosure may include a controller main body 120 from which a capsule type bidet filter 400 is detachable through an upper portion, a water supply part 150 configured inside the controller main body 120 and supplying raw water to the bidet filter 400, an operation part 110 configured in the controller main body 120 and controlling the water supply part 150, an opening and closing cover part 130 coupled to the upper portion of the controller main body 120 and sealing the bidet filter 400, and a filter detachable frame 300 provided in the controller main body 120 and on which the bidet filter 400 is detachably seated to support an inflow of water and a supply of purified cleaning water to a nozzle assembly of a bidet.

According to one embodiment of the present disclosure, the controller main body 120 may include a cover adhesion part 122 configured in close contact with a lower surface of the opening and closing cover part 130 to prevent raw water or cleaning water from leaking out of the controller main body 120, a filter receiving part 124 formed on the cover adhesion part 122 to accommodate the bidet filter 400 from upper to lower position, an opening and closing rotation shaft 128 formed at a rear side of the cover adhesion part 122 and rotatably coupled to the opening and closing cover part 130, a cleaning water provision part 126 formed on one side of the controller main body 120 and connected to the nozzle assembly of the bidet, and an opening and closing operation means 160 configured at a front side of the cover adhesion part 122 and supporting an operation of either opening or closing the opening and closing cover part 130.

According to one embodiment of the present disclosure, the opening and closing operation means 160 may include an operation support bracket 162 protruding upward from the front side of the cover adhesion part 122 and including an insertion groove formed on one side, and an elastic panel 164 inserted into the operation support bracket 162 and separating or coupling the opening and closing cover part 130 from or to the opening and closing operation means 160.

According to one embodiment of the present disclosure, the opening and closing cover part 130 may include an upper opening and closing cover part **130*a* that supports the opening and closing operation to be performed, and a lower opening and closing cover part 130*b* coupled to a lower portion of the upper opening and closing cover part 130*a* and inserted into the cover adhesion part 122 to press an upper surface of the bidet filter 400**.

According to one embodiment of the present disclosure, the upper opening and closing cover part **130*a* may include an opening and closing switch 132 that operates the opening and closing operation means 160, and a switch operation groove 132*a* that guides a sliding movement of the opening and closing switch 132**.

According to one embodiment of the present disclosure, the lower opening and closing cover part **130*b* may include a support bracket 134 configured to be fixed to and separated from the opening and closing operation means 160 depending on whether or not the opening and closing switch 132 is operated, a locking groove 133 into which the opening and closing operation means 160 is inserted and supported in a fixed state with the support bracket 134, a filter pressing part 135 formed on a lower surface and pressing the upper surface of the bidet filter 400, and a rotation bracket 136 configured at a rear side and rotatably coupled to the controller main body 120**.

According to one embodiment of the present disclosure, the water supply part 150 may include a water supply port 152 to which the same water supply line is connected, a water supply control unit 156 that controls whether or not to supply the raw water flowing in through the water supply port 152 based on control of the operation part 110, and a water supply pipe 158 connecting the water supply control unit 156 and the filter detachable frame 300 so that raw water to be supplied is moved toward the filter detachable frame 300.

According to one embodiment of the present disclosure, the filter detachable frame 300 may include a connecting member 310 connected to the controller main body 120, a filter detachable housing 330 configured at a lower portion of the connecting member 310 and on which a lower surface of the bidet filter 400 is seated, wherein the filter detachable housing 330 is connected to the water supply part 150 to receive the raw water and supplies the filtered and purified cleaning water to the nozzle assembly, a water supply pipe connection part 340 connecting the water supply part 150 and the filter detachable housing 330, and a water supply pipe 350 connected to one side of the filter detachable housing 330 and supplying the cleaning water to the nozzle assembly.

According to one embodiment of the present disclosure, the water supply pipe connection part 340 may include a central through hole extending through a center to allow the raw water to flow in, and a raw water supply groove 342 formed on one side of an upper end to allow the raw water to flow into the bidet filter 400.

According to one embodiment of the present disclosure, the filter detachable housing 300 may include a filter fixing part 332 that supports the bidet filter 400 in a seated and fixed state, a cleaning water supply part 336 that receives cleaning water and moving it to the water supply pipe 350, and a cleaning water supply pipe connecting the bidet filter 400 and the cleaning water supply part 336.

According to one embodiment of the present disclosure, the bidet filter 400 may include an outer body 410 configured in such a shape that a diameter thereof gradually increases as it goes from upper to lower position, with a lower end being open and connected to a water supply part 150 so as to supply raw water, an inner body 430 coupled inside the outer body 410, the inner body 430 including a ceramic ball that provides oriental medicine therapy or aroma therapy function when in contact with inflowing raw water, and discharging the filtered and purified cleaning water, a finishing member 440 coupled to an open lower end of the outer body 410, and a filtration filter 450 coupled to a lower end of the inner body 430, filtering and purifying inflowing raw water, and introducing the filtered and purified raw water to the direction of the ceramic ball.

According to the embodiments of the present disclosure described above, by allowing a capsule type bidet filter for purifying cleaning water to be detachably coupled to the controller to an upper portion of the controller that controls the operation of the bidet and also controls whether or not to supply the cleaning water, there is an effect of providing the convenience of replacing a capsule type bidet filter.

Further, the various and beneficial advantages and effects of the present disclosure are not limited to the above description, and can be more easily understood in the course of describing a specific embodiment of the present disclosure.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION

Figure 1:
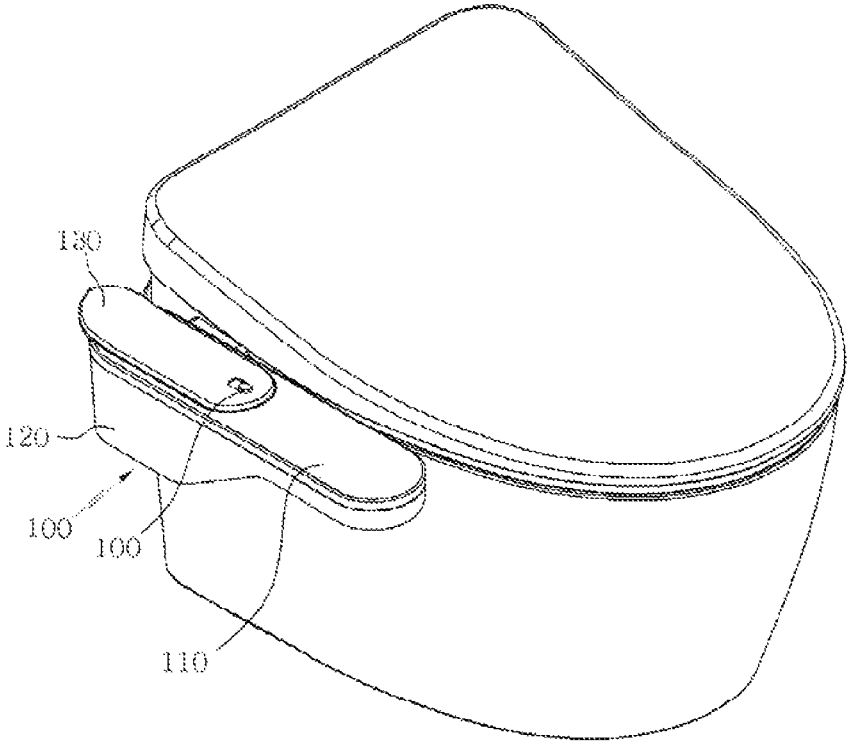
FIG. 1 is a view showing a bidet configured with an upper retractable controller for a bidet filter according to an embodiment of the present disclosure.
Figure 2:
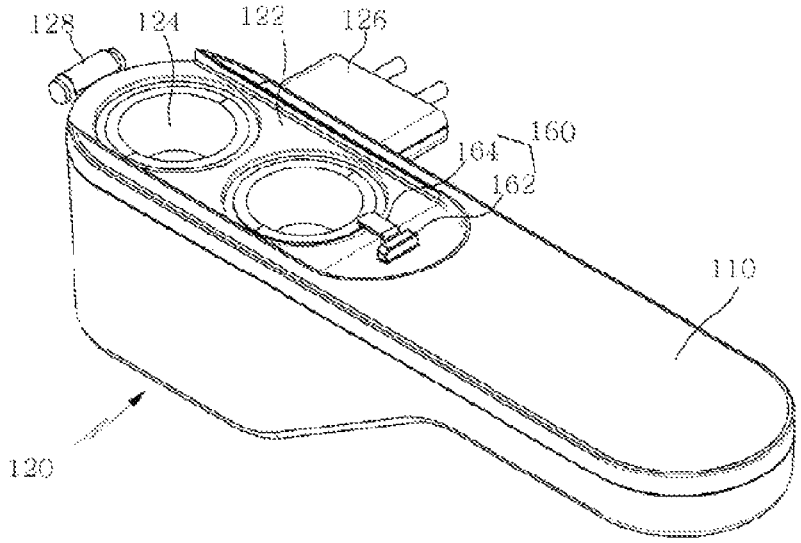
FIG. 2 is a perspective view of a controller main body of the upper retractable controller for the bidet filter according to an embodiment of the present disclosure.
Figure 3:
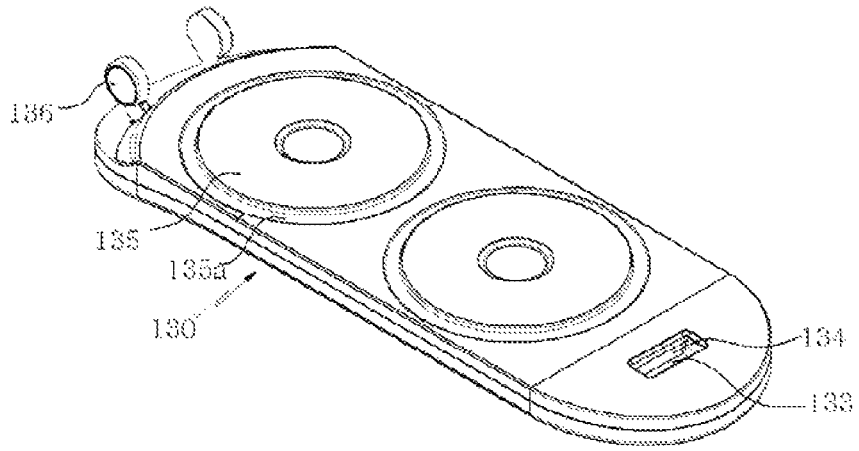
FIG. 3 is a bottom perspective view of an opening and closing cover part of the upper retractable controller for a bidet filter according to an embodiment of the present disclosure.

Hereinafter, preferred embodiments of the present disclosure will be described in detail with reference to the accompanying drawings. It should be noted that, when adding reference numerals to the components shown in the drawings, the same components, whether they are illustrated in the same drawing or different drawings, will be denoted by the same reference numerals. In the following description of the present disclosure, a detailed description of known functions and configurations incorporated herein will be omitted when it may make the subject matter of the present disclosure rather unclear.

In addition, it is to be understood that, unless specifically stated to the contrary, the term "comprise", "include", or "have" as used herein may mean that a corresponding component can be inherently included, and therefore, should be construed as meaning that other components may be additionally included rather than excluding the same, and all terms including technical or scientific terms have the same meaning as commonly understood by one of ordinary skill in the art to which this disclosure belongs, unless otherwise defined. Further, in the description of the components of the present disclosure, "first," "second," "A," "B," "(a)," "(b)" may be used to identify the components. These are used to distinguish a component from another component, and used only for convenience of explanation, and the nature, sequence, or order of the corresponding component is not limited by these expressions. When a certain component is stated as being "connected" or "coupled" to another component, it is to be understood that there may be yet another intervening component "connected" or "coupled between the two components, although the two components may also be directly connected or coupled to each other.

Hereinafter, embodiments of the present invention will be described in detail with reference to the accompanying drawings.

As shown, an upper retractable controller 100 for a bidet filter of the present disclosure includes a nozzle assembly formed on an upper surface and configured in a bidet, an operation part 110 that controls whether or not to supply raw water to be supplied to the nozzle assembly, a controller main body 120 configured at a rear side of the operation part 110, configured such that a capsule type bidet filter 400 is attachable from an upper portion, and configured with a water supply part 150, and an opening and closing cover part 130 rotatably coupled to the upper portion of the controller main body 120 and closing the bidet filter 400 in seated state.

The controller main body 120 is configured such that the operation part 110 is coupled to an upper front portion thereof, and the water supply part 150 is formed therein, such that the water supply part 150 is operated depending on a control signal transmitted from the operation part 110.

Figure 4:
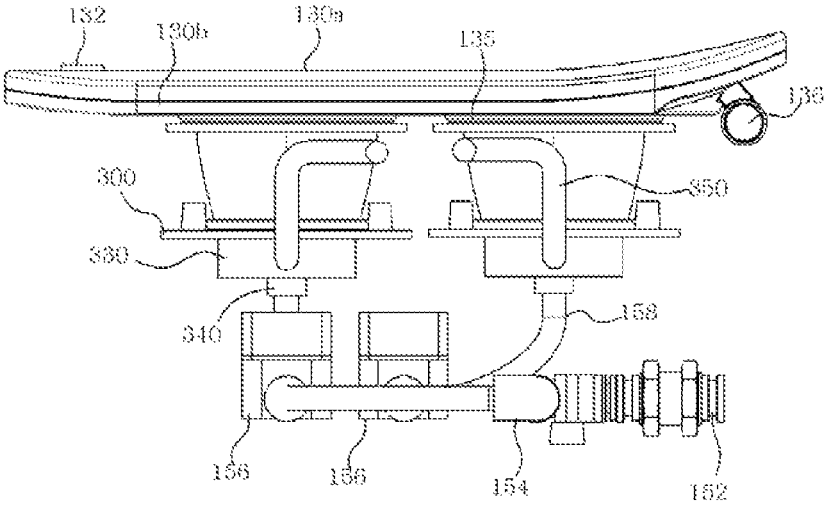
FIG. 4 is a view showing a water supply part of the upper retractable controller for the bidet filter according to an embodiment of the present disclosure.
Figure 5:
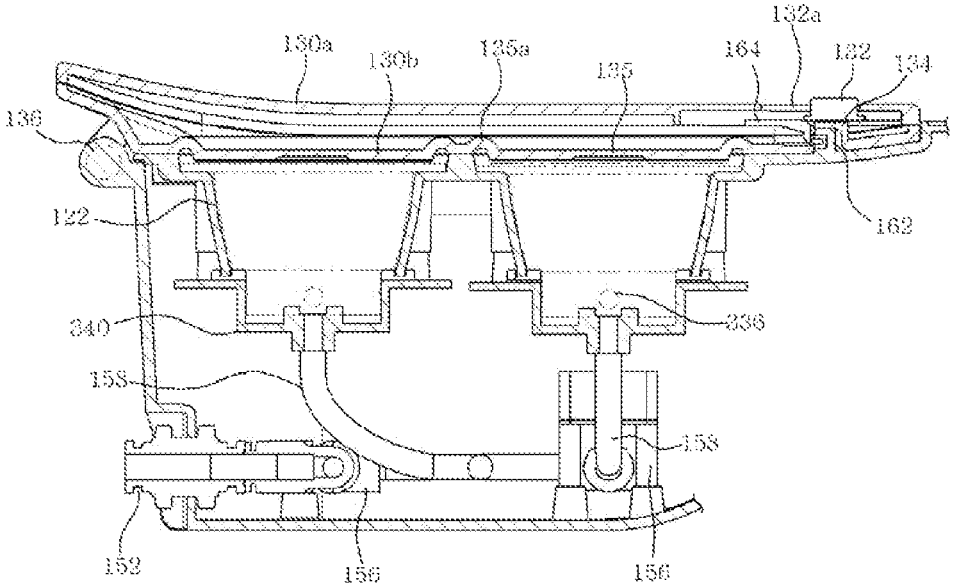
FIGS. 5 and 6 are cross-sectional views of the upper retractable controller for the bidet filter according to an embodiment of the present disclosure.
Figure 6:
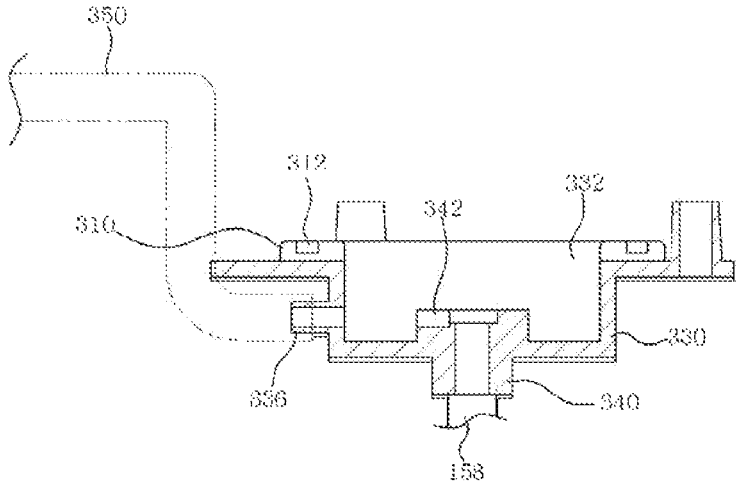
Figure 7:
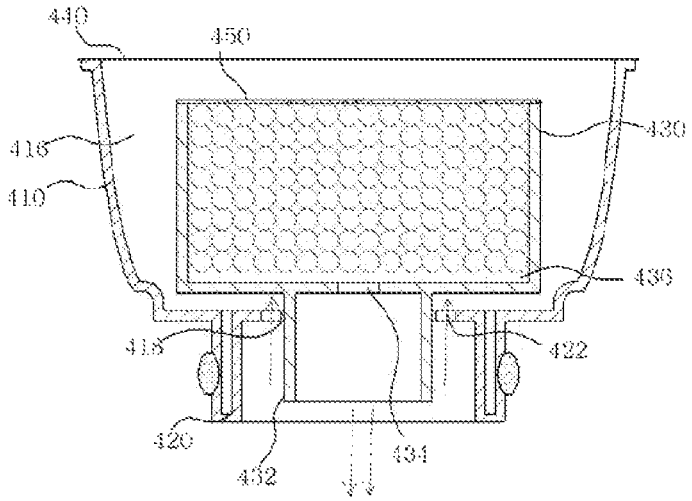
FIG. 7 is a cross-sectional view of a bidet filter according to an embodiment of the present disclosure.

In this example, as shown in FIG. 4, the water supply part 150 is mounted inside the controller main body 120, preferably in a mounting space provided below a filter receiving part 124, and has a water supply port 152 to which a water supply line such as a water pipe is connected.

This water supply part 150 is configured with a water supply control unit 156 that supplies supply water (or raw water) flowing in through the water supply port 152 to a water supply pipe connection part 340 of a filter detachable frame 300 under the control of the operation part 110, or blocks the supply.

In this example, the water supply part 150 includes a water supply pipe connection pipe 158 that connects the water supply control unit 156 and a water supply pipe connection unit 340 so as to move the raw water to be supplied toward the water supply pipe connection part 340.

It is preferable that the number of water supply control units 156 corresponds to the number of filter detachable frames 300 provided in the upper retractable controller 100 of the present disclosure, but embodiments are not limited thereto.

In addition, when the water supply part 150 includes two or more filter detachable frames 300, the water supply part 150 includes a water distribution unit 154 that distributes the raw water flowing in through the water supply port 152 so that the water can be supplied to one, or two or more filter detachable frames 300 of the plurality of filter detachable frames 300.

This controller main body 120 is configured in the upper rear side and forms the upper surface, and includes a cover adhesion part 122 to which a lower surface of the opening and closing cover part 130 is closely contacted so as to prevent the raw water or cleaning water from leaking out of the controller main body 120 while the opening and closing cover part 130 is closed.

In this example, the cover adhesion part 122 includes the filter receiving part 124 so that the bidet filter 400 is seated thereon from upper to lower position for filtration and purification of the raw water supplied from the water supply part 150.

Although it is described that two filter receiving parts 124 are formed, embodiments are not limited thereto, and one, or two or more bidet filters 400 may be provided so that the one, or two or more bidet filters 400 may be inserted.

In addition, in the controller main body 120, the opening and closing cover part 130 is coupled to the rear end of the cover adhesion part 122, and an opening and closing rotation shaft 128 that supports the opening and closing operation of the opening and closing cover part 130 is provided.

In addition, the controller main body 120 includes a cleaning water provision part 126 which is formed on a surface where the controller main body 120 and the bidet are connected to each other, and which is connected to a supply pipe 350 (to be described below) which is formed in the filter detachable frame 300, so as to supply the cleaning water filtered and purified by the bidet filter 400 inserted into the filter receiving part 124 to the nozzle assembly side of the bidet.

At this time, the cleaning water provision part 126 is preferably configured to be detachably coupled to the bidet body such that the controller main body 120 and the bidet body can be coupled to each other.

In addition, an opening and closing operation means 160 is provided at a front side of the cover adhesion part 122 to support the operation of either opening or closing the opening and closing cover part 130.

The opening and closing operation means 160 includes an operation support bracket 162 protruding upward from the front side of the cover adhesion part 122 and including an insertion groove formed on one side, and an elastic panel 164 inserted into the operation support bracket 162 and configured to allow the opening and closing cover part 130 to be separated from or coupled to the opening and closing operation means 160 according to whether or not an opening and closing switch 132 of the opening and closing cover part 130 is operated.

When the opening and closing cover part 130 is in closed state, the opening and closing operation means 160 is inserted to and fixed in a support bracket 134 included in the opening and closing cover part 130, thereby preventing the opening and closing cover part 130 from being opened arbitrarily.

In addition, the opening and closing operation means 160 is configured such that, in order to open the opening and closing cover part 130, the opening and closing switch 132 formed in the opening and closing cover part 130 slides along an upper surface of the support bracket 134 and presses the elastic panel 164 to achieve elastic operation, and then the elastic panel 164 moves elastically downward, thus releasing the fixation of the operation support bracket 162 and the support bracket 134, thereby opening the opening and closing cover part 130.

Meanwhile, the opening and closing cover part 130 of the present disclosure opens and closes the cover adhesion part 122 of the controller main body 120 and supports the bidet filter 400 so that it can be inserted into the filter receiving part 124 formed in the cover adhesion part 122, or presses the inserted bidet filter 400 to tightly fix it to the filter detachable frame 300, in which the front side of the opening and closing cover part 130 is detachably coupled to the opening and closing operation means 160, and the rear side is rotatably coupled to the opening and closing rotation shaft 128.

The opening and closing cover part 130 includes an upper opening and closing cover part **130*a* that supports the opening and closing operation to be performed, and a lower opening and closing cover part 130*b* coupled to a lower portion of the upper opening and closing cover part 130*a* and inserted into the cover adhesion part 122 to press an upper surface of the bidet filter 400**.

The upper opening and closing cover part **130*a* includes the opening and closing switch 132 for operating the opening and closing operation means 160, and a switch operation groove 132*a* that guides the opening and closing switch 132** to move in a sliding manner.

In addition, the lower opening and closing cover part **130*b* includes the support bracket 134 configured to be fixed to and separated from the opening and closing operation means 160 depending on whether or not the opening and closing switch 132 is operated, and a locking groove 133 into which the opening and closing operation means 160 is inserted toward the support bracket 134 and is supported in the fixed state with the support bracket 134**.

In addition, the lower opening and closing cover part 130*b* includes a filter pressing part 135 which is formed on the lower surface, is preferably configured to be located coaxially with the filter receiving part 124, and presses the upper surface of the bidet filter 400 inserted into the filter receiving part 124.

In this example, the filter pressing part 135 preferably includes a sealing groove 135*a* into which a sealing member such as an O-ring is inserted to prevent the raw water or cleaning water from leaking out.

In this example, the filter pressing part 135 is shown in such a form that includes two grooves, but embodiments are not limited thereto, and one groove, or although not shown, two or more grooves may be provided.

In addition, the opening and closing cover part 130 includes a rotation bracket 136 formed at a rear side and into which the opening and closing rotation shaft 128 formed in the cover adhesion part 122 of the controller main body 120 is rotatably inserted so as to support the opening and closing operation of the opening and closing cover part 130.

Figure 8:
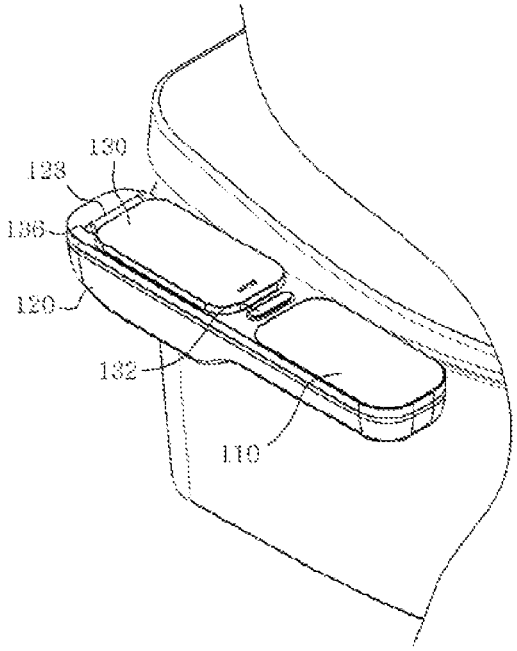
FIGS. 8 and 9 are perspective views of an upper retractable controller for a bidet filter according to another embodiment of the present disclosure.
Figure 9:
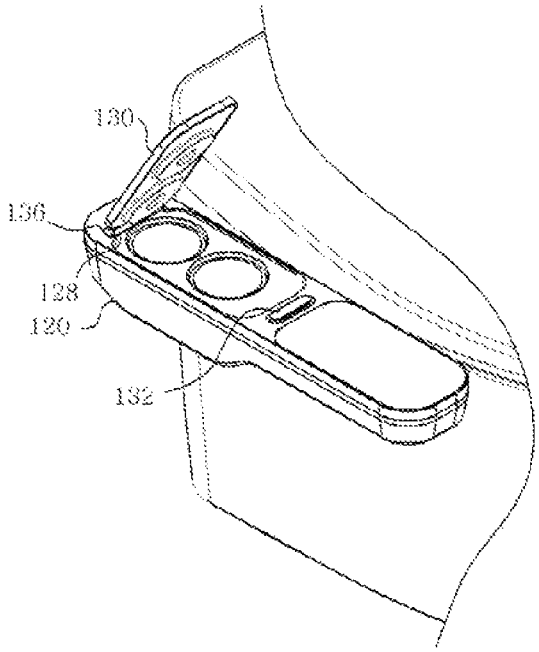

Meanwhile, the opening and closing cover part 130 of the present disclosure has been described above, in which the rotation bracket 136 is rotatably coupled to the opening and closing rotation shaft 128 formed at the rear side of the controller main body 120, but embodiments are not limited thereto. As shown in FIGS. 8 and 9, it may be configured such that the rotation bracket 136 is formed on an upper surface of the cover adhesion part 122, and the corresponding opening and closing rotation shaft 128 is formed at a rear central portion of the opening and closing cover part 130 to be rotatably coupled to the rotation bracket 136 included in the controller main body 120.

In addition, the opening and closing cover part 130 of the present disclosure has been described above, in which the opening and closing switch 132 operates the opening and closing operation means 160 by a sliding movement method, but embodiments are not limited thereto, and it may be configured such that the opening and closing switch 132 is configured in an upper front part of the controller main body 120, and upon lowering the opening and closing switch 132, the corresponding opening and closing operation means 160 is released from the fixation with the opening and closing switch 132 and open.

The opening and closing switch 132 having a structure that is lifted and lowered may be configured with a normal locking device, but embodiments are not limited thereto.

In addition, the controller main body 120 of the present disclosure includes the filter detachable frame 300 on which the bidet filter 400 is detachably seated and supports the inflow of water and the supply of purified cleaning water to the nozzle assembly of the bidet.

The filter detachable frame 300 is configured inside the controller main body and detachably coupled to a lower surface of the bidet filter 400 120 seated on the opening and closing cover part 130, connects the combined bidet filter 400 and the water supply part 150 so that the inflowing water is filtered and purified, and supplies the filtered and purified cleaning water to the nozzle assembly, and the filter detachable frame 300 includes a connecting member 310, a filter detachable housing 330 and the supply pipe 350.

The connecting member 310 is configured to form a circular flange at an upper portion of the filter detachable housing 330, and includes a receiving part coupling groove 312 formed along the circumferential surface such that a lower end of the filter receiving part 122 is fixedly coupled therein.

The filter detachable housing 330 is configured to be coupled to the controller main body 120 by the connecting member 310 and to allow the raw water to flow into the bidet filter 400 upon seating of the lower surface of the bidet filter 400, while also allowing the filtered and degraded cleaning water to be discharged from the bidet filter 400.

This filter detachable housing 330 includes a filter fixing part 332 formed in an upper central portion and supporting the bidet filter 400 to be seated and fixed, and the water supply pipe connection part 340 formed at a lower center of the filter fixing part 332 and connected to the water supply pipe 158 so as to guide the raw water to flow into the bidet filter 400.

In this example, the water supply pipe connection part 340 includes a through hole extending through the center to allow the inflow of raw water, and includes a raw water supply groove 342 formed on one side of the upper end perpendicularly to the central through hole so as to allow the inflowing raw water to flow into a raw water supply hole 422 of the bidet filter 400.

In addition, the filter detachable housing 330 includes a cleaning water supply part 336 that is coupled at one side with the water supply pipe 350 and receives the filtered and purified cleaning water while passing through the bidet filter 400 and moves the received water to the water supply pipe 350.

Although not shown in the drawings, the cleaning water supply part 336 further includes a cleaning water supply pipe that is connected to a connection flange 432 provided in the bidet filter 400 and supplies the cleaning water to the cleaning water supply part 336.

Meanwhile, the supply pipe 350 is configured to connect the cleaning water supply part 336 and the cleaning water provision part 126 so as to move the cleaning water supplied from the cleaning water supply part 336 to the cleaning water provision part 126 such that the cleaning water filtered and purified from the bidet filter 400 can be supplied to the nozzle assembly side of the bidet.

Meanwhile, the bidet filter 400, which is detachably coupled to the controller of the present disclosure includes an outer body 410 connected to a water supply pipe and to which raw water is supplied, and an inner body 430 formed inside the outer body 410 to filter and purify the supplied raw water, and to deliver the purified raw water, which is purified by a contact with ceramic balls containing an aroma component and thus contains the aroma component, to a nozzle side.

The outer body 410 is formed in a circular shape and in such a shape that its diameter gradually increases from upper to lower position, is configured such that a lower end is open to allow coupling with the inner body 430, and includes a coupling hole 418 through which the inner body 430 is coupled through an upper central portion, and a raw water moving part 416 that allows the supplied raw water to move to the lower surface of the inner body 430 and guides the moved raw water to flow into the inner body 430.

In addition, the outer body 410 includes a filter mounting part 420 detachably connected at its upper end to the water supply pipe and formed such that the raw water supplied from the water supply pipe can be supplied into the outer body 410.

When raw water is supplied with the open lower end of the outer body 410 being closed, a finishing member 440 that guides the raw water to flow into the inner body 430 is joined to the outer body 110.

Meanwhile, the filter mounting part 420 is formed to extend upward from the upper central portion, is detachably coupled to the filter detachment device to be connected to the water supply pipe to supply raw water, is formed integrally with the outer body 410, and includes a raw water supply hole 422 formed through it to supply raw water from the water supply pipe.

The filter mounting part 420 may preferably be configured to be separated from and coupled to the filter detachment device in a one-touch manner, but embodiments are not limited thereto, and the filter mounting part 120 may be coupled by a screw coupling method, and can be easily coupled to and detached from the filter detachment device provided in the existing upper retractable controller 100.

The inner body 430 is coupled inside the outer body 410, with its upper end being coupled to the filter detachment device and also connected to the raw water discharge pipe connected to the nozzle, and it is a component configured to allow the inflow of supplied raw water, filter and purify the inflowing raw water, and discharge the water to the raw water discharge pipe.

This inner body 430 includes a connection flange 432 formed to extend upward to the upper central portion and connected to the raw water discharge pipe to allow the filtered and purified raw water to flow into the raw water discharge pipe.

In addition, the inner body 430 includes a raw water outflow hole 434 formed through the central portion of the lower end of the connection flange 432 and allowing the filtered and purified raw water to flow out.

In addition, the inner body 430 includes a raw water purification part 436 containing ceramic balls therein, guides the inflowing raw water to move upward while contacting the ceramic balls, and allows the upwardly moving raw water to flow out through the raw water outflow hole 434.

In an example, the ceramic ball is a mixture of natural aromatic materials that provide oriental medicine therapy or aromatherapy functions at a certain weight ratio, and it provides the beneficial components of natural fragrance materials while in contact with raw water.

In addition, in the present disclosure, the inner body 430 is provided with a filtration filter 450 that filters and purifies the raw water supplied to the outer body 410 when the raw water flows into the inner body 430.

The above description is merely illustrative of the technical idea of the present invention, and those of ordinary skill in the art to which the present invention pertains will be able to make various modifications and variations without departing from the essential characteristics of the present invention. Accordingly, the embodiments disclosed in the present invention are not intended to limit the technical idea of the present invention, but to explain the technical idea, and the scope of the technical idea of the present invention is not limited by these embodiments. The scope of protection of the present invention should be interpreted by the following claims, and all technical ideas within the scope equivalent thereto should be construed as being included in the scope of the present invention.

The invention claimed is:

1. An upper retractable controller for a bidet filter, comprising:

a controller main body from which a capsule type bidet filter is detachable through an upper portion;

a water supply part configured inside the controller main body and supplying raw water to the bidet filter;

an operation part configured in the controller main body and controlling the water supply part;

an opening and closing cover part coupled to the upper portion of the controller main body and sealing the bidet filter; and a filter detachable frame provided in the controller main body and on which the bidet filter is detachably seated to support an inflow of water and a supply of purified cleaning water to a nozzle assembly of a bidet, wherein the controller main body includes:

a cover adhesion part configured in close contact with a lower surface of the opening and closing cover part to prevent raw water or cleaning water from leaking out of the controller main body;

a filter receiving part on the cover adhesion part to accommodate the bidet filter from upper to lower position;

an opening and closing rotation shaft formed at a rear side of the cover adhesion part and rotatably coupled to the opening and closing cover part;

a cleaning water provision part formed on one side of the controller main body and connected to the nozzle assembly of the bidet; and an opening and closing operator configured at a front side of the cover adhesion part and supporting an operation of either opening or closing the opening and closing cover part, wherein the opening and closing operator includes:

an operation support bracket protruding upward from the front side of the cover adhesion part and including an insertion groove formed on one side; and an elastic panel inserted into the operation support bracket and separating or coupling the opening and closing cover part from or to the opening and closing operator, wherein the opening and closing cover part includes:

an upper opening and closing cover part that supports the opening and closing operation to be performed; and a lower opening and closing cover part coupled to a lower portion of the upper opening and closing cover part and inserted into the cover adhesion part to press an upper surface of the bidet filter.

2. The upper retractable controller according to claim 1, wherein the upper opening and closing cover part includes:

an opening and closing switch that operates the opening and closing operator; and a switch operation groove that guides a sliding movement of the opening and closing switch.

3. The upper retractable controller according to claim 2, wherein the lower opening and closing cover part includes:

a support bracket configured to be fixed to and separated from the opening and closing operator depending on whether or not the opening and closing switch is operated; and a locking groove into which the opening and closing operator is inserted and supported in a fixed state with the support bracket;

a filter pressing part formed on a lower surface and pressing the upper surface of the bidet filter; and a rotation bracket configured at a rear side and rotatably coupled to the controller main body.

4. The upper retractable controller according to claim 1, wherein the water supply part includes:

a water supply port to which the same water supply line is connected;

a water supply control unit that controls whether or not to supply the raw water flowing in through the water supply port based on control of the operation part; and a water supply pipe connecting the water supply control unit and the filter detachable frame so that raw water to be supplied is moved toward the filter detachable frame.

5. The upper retractable controller according to claim 1, wherein the filter detachable frame includes:

a connecting member connected to the controller main body;

a filter detachable housing configured at a lower portion of the connecting member and on which a lower surface of the bidet filter is seated, wherein the filter detachable housing is connected to the water supply part to receive the raw water and supplies the filtered and purified cleaning water to the nozzle assembly;

a water supply pipe connection part connecting the water supply part and the filter detachable housing; and a water supply pipe connected to one side of the filter detachable housing and supplying the cleaning water to the nozzle assembly.

6. The upper retractable controller according to claim 5, wherein the water supply pipe connection part includes a central through hole extending through a center to allow the raw water to flow in, and a raw water supply groove formed on one side of an upper end to allow the raw water to flow into the bidet filter.

7. The upper retractable controller according to claim 5, wherein the filter detachable housing includes:

a filter fixing part that supports the bidet filter in a seated and fixed state;

a cleaning water supply part that receives cleaning water and moving it to the water supply pipe; and a cleaning water supply pipe connecting the bidet filter and the cleaning water supply part.

8. The upper retractable controller according to claim 1, wherein the bidet filter includes:

an outer body configured in such a shape that a diameter thereof gradually increases as it goes from upper to lower position, with a lower end being open and connected to a water supply part so as to supply raw water;

an inner body coupled inside the outer body, the inner body including a ceramic ball that provides oriental medicine therapy or aroma therapy function when in contact with inflowing raw water, and discharging the filtered and purified cleaning water;

a finishing member coupled to an open lower end of the outer body; and a filtration filter coupled to a lower end of the inner body, filtering and purifying inflowing raw water, and introducing the filtered and purified raw water to the direction of the ceramic ball.

* * * * *